United States Patent [19]

Kern et al.

[11] Patent Number: 4,472,715

[45] Date of Patent: Sep. 18, 1984

[54] DUAL SPECTRUM FIRE SENSOR WITH DISCRIMINATOR

[75] Inventors: Mark T. Kern, Goleta; Robert J. Cinzori, Santa Barbara, both of Calif.

[73] Assignee: Santa Barbara Research Center, Goleta, Calif.

[21] Appl. No.: 384,458

[22] Filed: Jun. 3, 1982

Related U.S. Application Data

[63] Continuation-in-part of Ser. No. 269,208, Jun. 2, 1981, abandoned.

[51] Int. Cl.[3] ..... G08B 17/12; G08B 29/00

[52] U.S. Cl. ..... 340/587; 340/530; 340/578; 340/589; 340/600

[58] Field of Search ..... 340/600, 587, 578, 589, 340/588, 584, 529, 530

[56] References Cited

U.S. PATENT DOCUMENTS

| | | | |
|---|---|---|---|
| 3,708,674 | 1/1973 | Trimpi et al. | 340/600 |
| 3,940,753 | 2/1976 | Müller | 340/578 |
| 4,206,454 | 6/1980 | Schapira et al. | 340/600 |

*Primary Examiner*—Glen R. Swann, III

*Attorney, Agent, or Firm*—J. Dennis Moore; Mark J. Meltzer; A. W. Karambelas

[57] ABSTRACT

A fire sensor discriminates between fires and the flash caused by a projectile piercing the wall of a protected area. The sensor system comprises first and second radiant energy detectors, each sensitive to radiation within different spectral bands. Each detector is coupled to a control signal means for generating a control signal when the radiation sensed exceeds a predetermined amplitude. A third control signal means is responsive to the first and second detectors, and is operative to generate a third control signal whenever the ratio of the amplitude of the energy sensed by the first detector to the amplitude of the energy sensed by the second detector is less than a predetermined value; not generate the third control signal whenever the ratio of amplitude exceeds the predetermined value; and delay generation of the third control signal for a predetermined period of time after the ratio of amplitudes falls below the predetermined value. An output control signal is then generated only if all three control signals are simultaneously generated. The decay of the flash radiation is thereby electrically simulated, allowing the fire sensor to sense whether a fire develops after the flash passes.

22 Claims, 6 Drawing Figures

VOLTAGE
$V_{T1}$
NODE a
$V_{T2}$
b
c
d
e
f
g
h
k
m
n
p
q
r
s
TIME
$t_1$
$t_2$
$t_3$
$t_4$
$t_5$
$t_6$
$t_7$
$t_8$

VOLTAGE
$V_{T3}$
NODE u
$V_{T4}$
v
w
x
y
z
zz
TIME
$t_{11}$
$t_{12}$
$t_{13}$
$t_{14}$
$t_{15}$

DUAL SPECTRUM FIRE SENSOR WITH DISCRIMINATOR

CROSS-REFERENCE TO A RELATED APPLICATION

This application is a continuation-in-part of pending prior application Ser. No. 269,208, filed on June 2, 1981 for Dual Spectrum Fire Sensor with Discrimination, now abandoned.

BACKGROUND OF THE INVENTION

1. Field of the Invention

This invention relates to the field of devices that sense the presence of an undesirable fire or explosion within a protected area or compartment, and thereafter cause a fire suppressant to be released to extinguish the fire.

More particularly, this invention relates to a device for distinguishing a fire from the flash produced, for example, by a projectile penetrating a wall of the protected area, and for triggering the release of suppressant only when it senses a fire.

2. Description of the Prior Art

There are many situations where the protection of human life requires that an area or a compartment be protected from fires. For instance, the crew and passenger compartments and the engines of aircraft are areas where a fire can quickly cause disaster. However, the fire suppressant carried on aircraft adds weight that reduces performance, and generally only the amount of suppressant necessary to extinguish expected fires is carried. The timing of the release of the suppressant is critical. If released too soon, it may be exhausted before it is really needed; if released too late, it may not be adequate to suppress the fire.

Military vehicles, such as aircraft, tanks and personnel carriers, may be vulnerable to fires caused by the entry of projectiles or flak. When a projectile or a piece of flak pierces a wall of a compartment, it causes a flash of radiant energy in the ultraviolet, the visible, and the infrared spectral regions. Prior art fire sensors, depending on their individual capabilities, are susceptible to two problems—the fire sensor might interpret the flash as a fire and release the suppressant before the fire actualy developed; or even if the fire sensor determined that the flash was not a fire, it might interpret a quickly developing fire as the continued presence of the flash, and thereby fail to release the suppressant. (In technical literature, the words "detector" and "sensor" are sometimes used synonymously. Here, "detector" refers to a radiation sensitive element which converts electromagnetic radiation to electrical signals. The word "sensor" refers to a system using at least one "detector", and which includes some other electronic apparatus to amplify or process the "detector" signals.)

For example, the fire sensor system disclosed in U.S. Pat. No. 4,206,454 to Shapira, et al. is a system for sensing fires, but which is subject to reacting to suppress the flash caused by a projectile penetration. Shapira's sensor system has two sensor channels, a long-wavelength sensitive channel, and a short-wavelength sensitive channel. A projectile flash radiates a quick-rising short-wavelength component and a slower-rising long-wavelength component which can cause Shapira's device to activate the release of suppressant as soon as the long-wavelength component passes the threshold level of the long-wavelength sensitive channel. But, such operation might be unnecessary if no fire results from the projectile penetration, or might occur too soon if the fire ignition is delayed, as when leaking fuel is subsequently ignited.

The fire sensor system disclosed in U.S. Pat. No. 4,220,857 to Bright is likewise disadvantageous since it is also subject to interpreting a projectile flash to be a fire. On impact, a projectile often releases a small amount of incendiary material or produces an explosion, both of which generate a large amount of carbon dioxide as the product of combustion, even though the combustion may be very short-lived and produces no sustained hydrocarbon fire. Since Bright's system is intended to respond to an event wherein non-Planckian carbon dioxide molecule emission at 4.4 micrometers (for example) exceeds Planckian emission at adjacent wavelengths, the Bright system is subject to producing a fire output signal in response to such a flash. Thus, suppressant might be released to suppress a flash and explosion that would dissipate shortly by itself.

The fire sensor system disclosed in U.S. Pat. No. 4,101,767 to Lennington, et al. is also limited in its capability to distinguish a flash from a fire. The Lennington system is basically a single channel fire sensor (including a 4.4 micrometer detector 30) with a discrimination circuit (detectors 10 and 20) added to inhibit an output signal as long as the color temperature is greater than some value (e.g. −2400° K.). This sensor system is explicitly adapted for responding to a HEAT round attack against an armored vehicle. In a HEAT round explosion, the 4.4 micrometer radiation component drops below the sensor threshold following the HEAT round impact before the short wavelength detectors signal a detected color temperature less than the preset value. In aircraft applications, however, projectile penetration flash radiation characteristics often follow a different pattern, and the Lennington system is susceptible to reacting to release suppressant to snuff such a flash that would actually dissipate rapidly by itself.

SUMMARY OF THE INVENTION

The general purpose of this invention is to provide a new and improved fire sensor which overcomes the above-described disadvantages of the prior art fire sensors, and which is operable to detect the presence of a fire and cause the release of a fire suppressant.

It is also a purpose of this invention to provide a new and improved fire sensor which is capable of discriminating between a sudden flash of radiant energy and a fire that develops so soon after the flash that the fire's radiant energy might be interpreted by a detector system as a continuation of the flash.

To accomplish these purposes while overcoming the disadvantages of the prior art described above, the present invention electrically simulates what would happen optically in the event there is a flash without a subsequent fire. The timing of the release of fire suppressant does not come so soon that an occasional false alarm results (that is, suppressant is released when a flash occurs but no fire follows), but yet does not come so late that the suppressant is inadaquate to extinguish a fire.

The present invention provides a three channel sensor system having a first detector capable of detecting electromagnetic energy within a first predetermined spectral band and generating a first control signal which is proportional to the level of the energy it detects, and a second detector capable of detecting electromagnetic energy within a second predetermined spectral band and generating a second control signal which is proportional to the level of the energy it detects. The first channel of the sensor system is responsive to the first detector and generates a third control signal whenever the first control signal exceeds a first predetermined level. The second channel of the sensor system is responsive to the second detector and generates a fourth control signal whenever the second control signal exceeds a second predetermined level. The third channel of the sensor system is responsive to both the first and second control signals and generates a fifth control signal until the difference between the amplitudes of the first and second control signals exceeds a third predetermined level. When the third level is exceeded, the third channel ceases generating the fifth control signal for a period of time which may be termed the "delay period." When the delay period has passed, the third channel will again generate the fifth control signal. The first, second, and third channels are electrically fed to an output circuit which generates an output signal only when the third, fourth, and fifth control signals are simultaneously received from the first, second, and third channels respectively. The output signal, when generated, may be further processed or used to activate electromechanical fire suppression equipment.

The length of the delay period may be determined in various ways by different types of delay circuits incorporated in the third channel. The types of delay circuit utilized may depend on the type of fire or explosion that might be expected to occur in the monitored area. A simpler type of delay circuit is one which merely interrupts the generation of the fifth control signal for a predetermined period of time after the difference between the first and second control signals exceeds the third predetermined level.

DETAILED DESCRIPTION OF THE INVENTION

Figure 1:
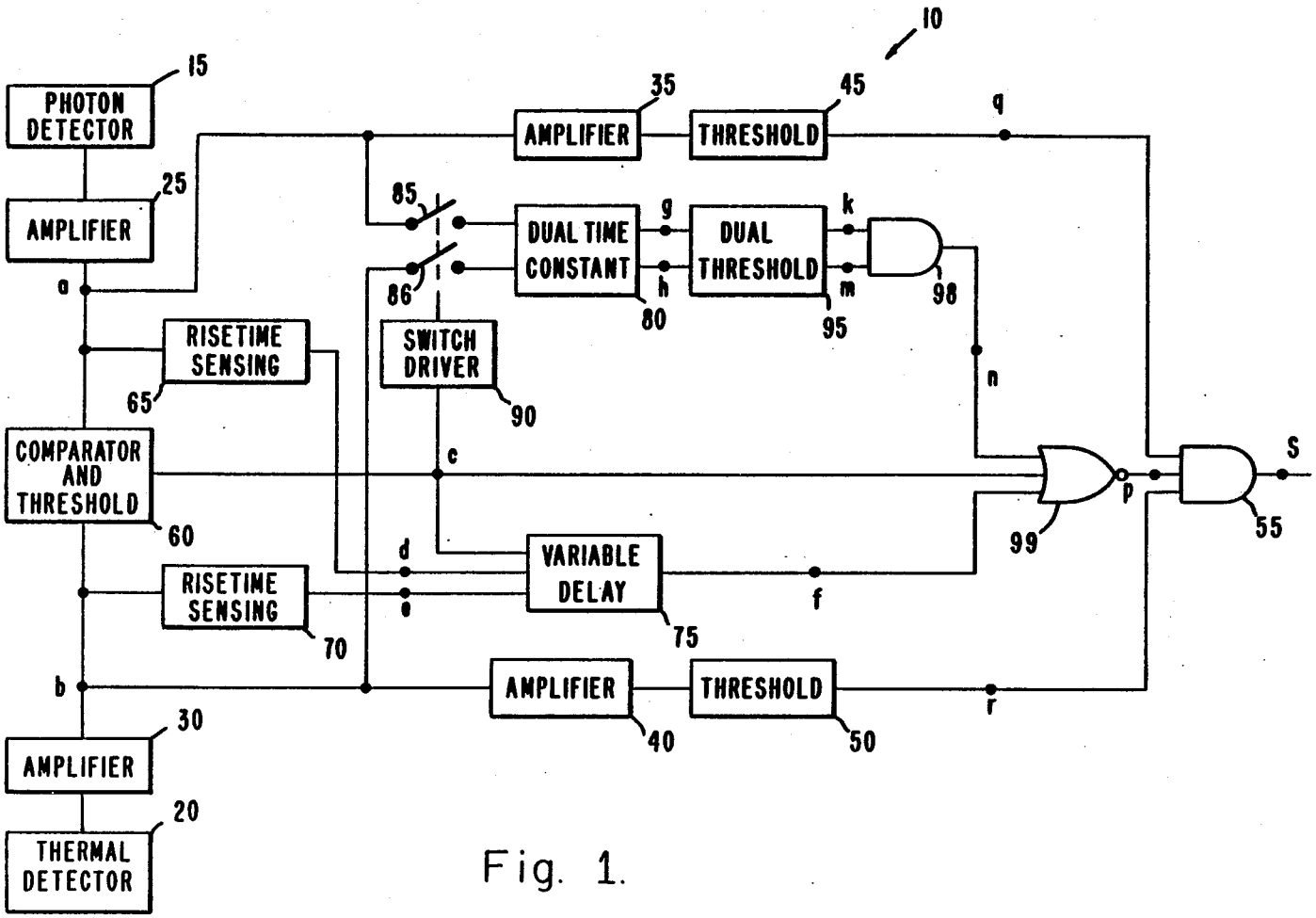
FIG. 1 is a block diagram of a three channel sensor system according to a first embodiment of this invention.

In FIG. 1, a three channel sensor system 10 has a photon detector 15 that is responsive to radiant energy within a spectral band of relatively short wavelength (0.7 to 1.2 microns, or 0.1 to 2.0 microns, for example), and a thermal detector 20 that is responsive to radiant energy within a spectral band of relatively long wavelength (6 to 30 microns, or 5 to 30 microns, for example). The analog output of each detector 15 and 20 is amplified by amplifiers 25 and 30, respectively. The outputs of amplifiers 25 and 30, which are hereinafter called nodes a and b, respectively, are fed to amplifiers 35 and 40, respectively. The output of amplifier 35 is fed to a threshold device 45 having a predetermined threshold level $V_{T1}$. The output of amplifier 40 is fed to a threshold device 50 having a predetermined threshold level $V_{T2}$. The threshold devices 45 and 50 are known devices which convert the respective analog outputs of amplifiers 35 and 40 to logical control signals. When the output of amplifier 35 is below the threshold level $V_{T1}$, the threshold device 45 generates no control signal (its output is a logical 0); but when the output of amplifier 35 exceeds the threshold level $V_{T1}$, the threshold device 45 does generate a control signal (its output is a logical 1). Threshold device 50 operates in a similar manner. Threshold devices 45 and 50 may be, for example, conventional comparators which operate with respect to set reference voltages. The outputs of the threshold devices 45 and 50, hereinafter called nodes q and r respectively, are fed to two inputs, respectively, of an AND gate 55.

The outputs of amplifiers 25 and 30 are fed to a comparator-threshold circuit 60. The comparator-threshold circuit 60 generates a logical control signal only when the difference between the amplitudes of its two inputs exceeds a predetermined level.

The threshold levels $V_{T1}$ and $V_{T2}$ are determined according to known principles, for example, as set forth in U.S. Pat. No. 3,931,521 to Cinzori. Thus, the combined gains of amplifiers 25 and 35 and the threshold level $V_{T1}$, and the combined gains of amplifiers 30 and 40 and the threshold $V_{T2}$ are selected such that devices 45 and 50 are triggered by a selected standard fire event, such as a five inch diameter pan fire at a distance of four feet from the detector.

The relative gain between amplifiers 35 and 40 is then set such that comparator threshold circuit 60 is triggered early enough in a flash event of the type to be discriminated against so as to precede the triggering of both threshold devices 45 and 50 and thereby ensure the inhibition of an output signal at node s. In typical applications, the ratio of the resultant gain settings between amplifier 35 and amplifier 40 will be set in the range of 3 to 10. Of course, to keep the combined gain of amplifiers 25 and 35 constant, if the gain of amplifier 35 is changed, a corresponding adjustment to the gain of amplifier 25 must also be made. The same considerations apply to amplifiers 30 and 40.

The output of amplifier 25 is also fed to a risetime sensing circuit 65, and the output of amplifier 30 is also fed to another risetime sensing circuit 70. Each risetime sensing circuit generates an analog output that is proportional to the rate of change of its input signal. The output of risetime sensing circuit 65, hereinafter called node d, and the output of risetime sensing circuit 70, hereinafter called node e, and the output of the comparator-threshold circuit 60, hereinafter called node c, comprise the three inputs to a variable delay circuit 75. The variable delay circuit 75 generates a logical control signal for a predetermined variable period of time, determined by the combined outputs of risetime sensing circuits 65 and 70, after receiving a control signal from comparator-threshold circuit 60.

Variable delay circuit 75 includes a one-shot device (not shown), the Q output of which comprises the output of circuit 75. The circuit 75 also includes known circuitry (not shown) which sums the signals at node d and node e. This summing can be weighted or unweighted, according to the application. For example, it may be desired to weight the long-wavelength component signal at node e more than the short wavelength component at node d, since fast-rising long-wavelength signals are more likely to be associated with flash phenomena desired to be discriminated against. This sum signal is used to vary the resistance of the RC time constant portion of the aforementioned one-shot device such that the resistance of the aforementioned RC time constant portion varies inversely with the amplitude of the sum signal. Thus, the output of variable delay circuit 75 is normally at logic level "0" and, in response to the falling edge of a signal at node c, the output goes to logic level "1" and remains "1" for a time period which varies inversely with the sum of the amplitude of the signals at nodes d and e.

The outputs of the amplifiers 25 and 30 are also fed to a dual time-constant circuit 80 through ganged single-pole switches 85 and 86 respectively. The states of the ganged switches 85 and 86 are controlled by a switch driver 90. The switch driver 90 is controlled by the output of the comparator-threshold circuit 60. If the comparator-threshold circuit 60 generates a control signal, the switch driver 90 drives the ganged switches 85 and 86 to their closed states; if the control signal ceases to be generated, the switch driver drives the ganged switches 85 and 86 to their open states. Therefore, the dual time-constant circuit 80 receives the outputs of amplifiers 25 and 30 only if the comparator-threshold circuit 60 generates its logical control signal (i.e.—if node c is "high").

The dual time constant circuit 80 comprises two subcircuits (not shown) the inputs of which are connected, respectively, to the two inputs of circuit 80, and the outputs of which are likewise connected, respectively, to the two outputs of circuit 80. These subcircuits, which may be simple RC time constant circuits connected to ground, each produce an output signal having an amplitude which varies in accordance with the amplitude and duration of the input signal applied thereto, as by the charging of the RC time constant subcircuits.

When the ganged switches 85 and 86 are closed, the dual time-constant circuit 80 is charged up by the potentials at nodes a and b. The outputs of the dual time-constant circuit 80, hereinafter called nodes g and h, are fed to a dual threshold circuit 95. The dual threshold circuit 95 converts the analog signals at nodes g and h to logical signals, which are applied to the outputs of circuit 95, hereinafter called nodes k and m. The dual threshold circuit 95 comprises two conventional threshold circuits, such as comparators which are each referenced to respective predetermined voltages. The threshold levels of threshold circuit 95 are set to levels corresponding to levels less than $V_{T1}$ and $V_{T2}$ such that threshold 45 or 50 will cease generating an output before a signal re-appears at the output of AND gate 98 for a flash of the type being discriminated against. The two inputs of the threshold circuits comprise the two inputs of circuit 95, respectively, and the outputs of the threshold circuits likewise comprise the respective outputs of circuit 95. The two outputs of the dual threshold circuit 95 are fed to the input ports of an AND gate 98.

The output of the AND gate 98, hereinafter called node n, the output of the comparator-threshold circuit 60, and the output of the variable delay circuit 75, hereinafter called node f, all comprise the inputs to a NOR gate 99. The output of the NOR gate 99, hereinafter called node p, comprises the third input to the AND gate 55. The output of the AND gate 55, hereinafter called node s, is fed to electromechanical fire suppression equipment (not shown).

In most explosive flashes, large amplitude optical signals take longer to decay than small amplitude optical signals. Therefore, by charging up time constant circuit 95 in accordance with the amplitude of the detected radiation signals, either long wavelength (node b) or short wavelength (node a), or both, the decay of time constant circuit 95 can be used to model or simulate the decay of the radiation produced by an explosive flash which is capable of triggering the fire radiation sensor portion of the circuitry associated with threshold devices 45 and 50.

The circuitry associated with variable delay 75 operates in a similar fashion. Few stimuli are capable of producing the fast-rising radiation signals that occur when an anti-aircraft projectile penetrates the skin of an aircraft. This is especially true at relatively longer wavelengths, e.g., 6–30 microns. Consequently, a time constant circuit the delay of which increases with rise-time of the radiation signal provides a relatively short delay (i.e.—in the range of about 1 to 30 milliseconds) for very fast-rising signals, thus permitting the release of suppressant at substantially the right time, and not interfering with the inhibition protection against the radiation associated with the flash provided by the circuitry of elements 80, 95 and 98. However, for very slow risetimes, (a few tenths of a second) such as may occur when maintenance personnel are moving about, very long delays (several seconds) can be generated.

Thus, the advantage of the circuitry associated with delay 75 is the provision of an increased immunity to common false alarm producing stimuli, whereas the circuitry associated with the dual time constant circuit 80 and dual threshold circuit 95 is adapted to simulate the decay of the projectile explosion flash and thus provide more effective discrimination between a flash and a fire.

Figure 2:
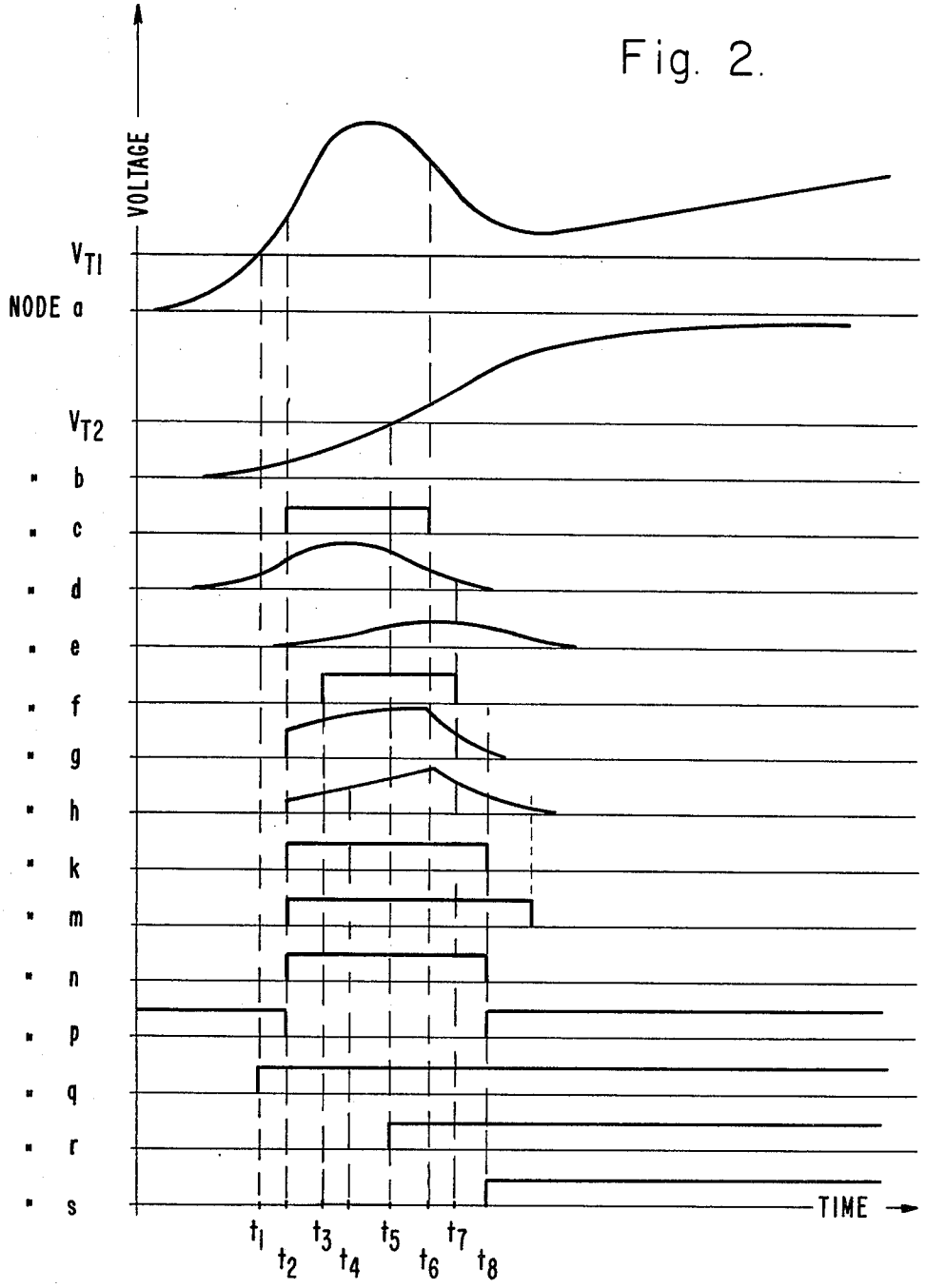
FIG. 2 is a timing diagram showing the operation of the sensor system of FIG. 1.

The operation of the sensor system of FIG. 1 is shown in the timing diagram of FIG. 2. The events depicted in FIG. 2 occur when a projectile or a piece of flak bursts through the wall of an area monitored by the sensor system 10 and causes a fire. When the projectile or piece of flak pierces the wall, it causes a flash of radiant energy. The flash comprises a relatively quick-rising short wavelength component which is detected by the photon detector 15, causing the waveform shown in FIG. 2 at node a. The flash also comprises a relatively slower-rising long wavelength component which is detected by the thermal detector 20, causing the waveform shown in FIG. 2 at node b.

As the waveform at node a exceeds the threshold value $V_{T1}$ at time $t_1$, the signal at node q rises to a logical 1, where it remains for as long as the waveform at node a remains above the threshold value $V_{T1}$. As the short wavelength component of the flash continues to rise faster than the long wavelength component, the difference between their amplitudes causes the comparator-threshold circuit 60 to generate its logical control signal at time $t_2$. The signal at node c energizes the switch driver 90 causing it to drive ganged switches 85 and 86 closed, thereby feeding the signals at nodes a and b to the dual time-constant circuit 80 causing the waveforms shown in FIG. 2 at nodes g and h.

As the dual time-constant circuit 80 charges up, the waveforms at nodes g and h trigger the dual threshold circuit 95 at time $t_2$, generating logical control signals at nodes k and m. Since both input signals to the AND gate 98 are logical "1s", gate 98 generates a logical control signal at time $t_2$. The NOR gate 99 generates a logical control signal when all of its inputs are logical "0s". When the comparator-threshold circuit 60 generates its control signal at time $t_2$, the NOR gate's output is inhibited, thereby inhibiting the generation of a control signal at node s.

As the relatively slower-rising long wavelength component of the flash increases, it causes the rise-time sensing circuit 70 to generate an output. At time $t_3$ variable delay circuit 75 responds to the amplitudes of the signals at nodes d and e to shorten the delay period of the signal at node f initiated at time $t_2$ by the signal at node c to end at time $t_7$. This delay period of time which is determined by the variable delay circuit 75 for the signal at node f. should be set such that the fast risetimes caused by the penetration of anti-aircraft fire produces shorter delays than that of the amplitude delay circuit. Thus, in such cases, the amplitude variable delay circuit dominates in the inhibition of the release of the suppressant for combat battle damage.

For very slow-rising radiation components, which give rise to very slow risetime signals, however, the amplitudes of the signals at nodes d and e are smaller and do not shorten the delay initiated at time $t_2$ from the maximum value set in variable delay circuit 75. Thus, the signal at node f might remain for several seconds, depending upon the maximum delay period setting, to inhibit against false activation by, for example, the movement of maintenance personnel.

The aforementioned slower-rising long wavelength component of the flash causes the signal at node b to rise above the threshold level $V_{T2}$ at time $t_5$ causing a logical 1 waveform at node r. At time $t_6$, the short wavelength component of the decaying flash falls off as the long wavelength component continues to rise, now due to the fire ignited by the projectile or piece of flak. The difference between their amplitudes causes the signals at nodes a and b to fall below the threshold level of the comparator-threshold circuit 60, causing it to cease generating a control signal, as seen at node c at time $t_6$. This, in turn, causes the ganged switches 85 and 86 to open and the dual time-constant circuit 80 output to begin decaying. When either of the waveforms at nodes g or h decay below the threshold of the dual threshold circuit 95, one of the inputs (here node k) is removed from the AND gate 98 at time $t_7$ causing its output to return to a logical 0.

At time $t_8$, the inputs to the NOR gate 99 are all logical "0", and the waveform at node p rises to a logical "1". Therefore, all three inputs to the AND gate 55 are logical "1s" and the AND gate 55 generates an output control signal at time $t_8$. This control signal can be utilized to cause the release of a suppressive material to extinguish the growing fire before it is out of control.

If no fire results from the projectile or piece of flak, the waveforms at nodes a and/or b remain below their respective threshold levels $V_{T1}$ or $V_{T2}$. In that case, node q and/or r remain logical "0", and the AND gate 55 does not generate its output control signal at time $t_8$.

Figure 3:
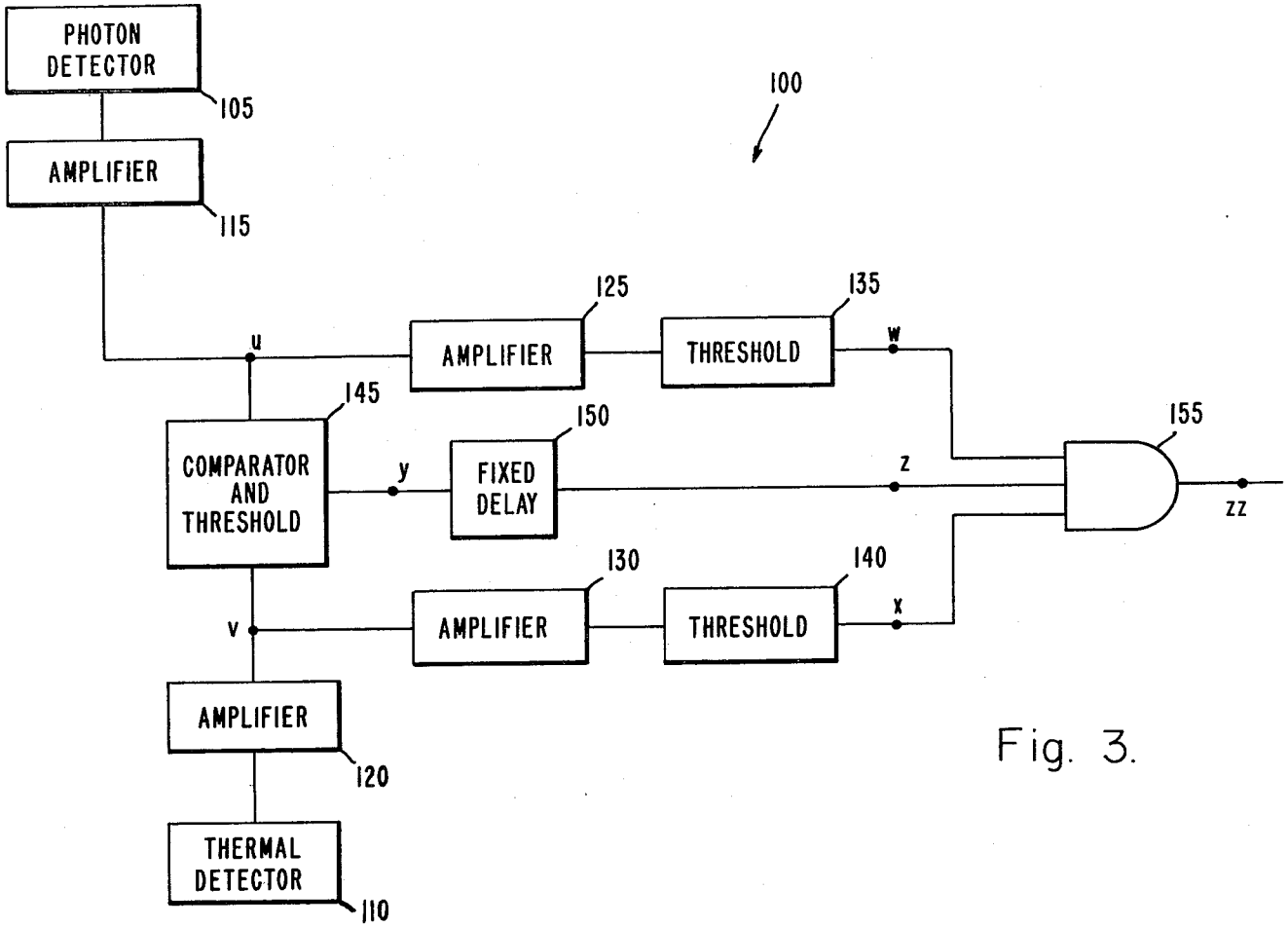
FIG. 3 is a block diagram of a three channel sensor system according to a second embodiment of this invention.

The present invention is not limited to the embodiment of FIG. 1. Another three channel sensor system 100 is shown in FIG. 3 which is, in fact, preferred. The sensory system 100 has a photon detector 105 and a thermal detector 110, each capable of detecting radiant energy within a certain spectral band and generating an output proportional to the amplitude of the detected radiation. Like the system of FIG. 1, the photon detector detects radiation in the 0.7 to 1.2 microns spectral band, and the thermal detector operates in the 6 to 30 micron spectral band. The output of the photon detector is amplified by an amplifier 115 and the output of the thermal detector 110 is amplified by an amplifier 120.

The outputs of the amplifiers 115 and 120, hereinafter called nodes u and v respectively, are fed to the inputs of a comparator-threshold circuit 145. In a manner similar to comparator-threshold circuit 60 of FIG. 1, the comparator-threshold circuit 145 generates a control signal at node y whenever the difference between the amplitudes of its input signals exceeds a predetermined threshold value. The outputs of the amplifiers 115 and 120 are also fed respectively to the amplifiers 125 and 130, which feed threshold circuits 135 and 140 respectively. The threshold circuit 135 generates a control signal at node w if its input exceeds a predetermined threshold value $V_{T3}$, and the threshold circuit 140 generates a control signal at node x if its input exceeds a predetermined threshold value $V_{T4}$. The outputs of the threshold circuits 135 and 140 comprise two of the inputs to an AND gate 155. The principles by which the gains of amplifiers 115, 120, 125 and 130, and the threshold device values of threshold devices 135 and 140, are determined are the same as those described above in connection with amplifiers 25, 30, 35 and 40, and threshold devices 45 and 50 of FIG. 1. Likewise, the predetermined threshold value of comparator and threshold circuit 145 is determined in the same way as that of comparator and threshold circuit 60 of FIG. 1.

The delay function of the sensor system 100 is performed by a fixed delay circuit 150. The fixed delay circuit 150 generates a logical control signal at node z in the absence of any input signal from the comparator-threshold circuit 145. When the comparator-threshold circuit 145 generates a logical control signal, the fixed delay circuit 150 ceases generating its control signal for the duration of the input signal and for a fixed predetermined period of time (delay period) thereafter. Since the output of the fixed delay circuit 150 comprises the third input to the AND gate 155, an output control signal at node zz is inhibited for the delay period.

Figure 5:
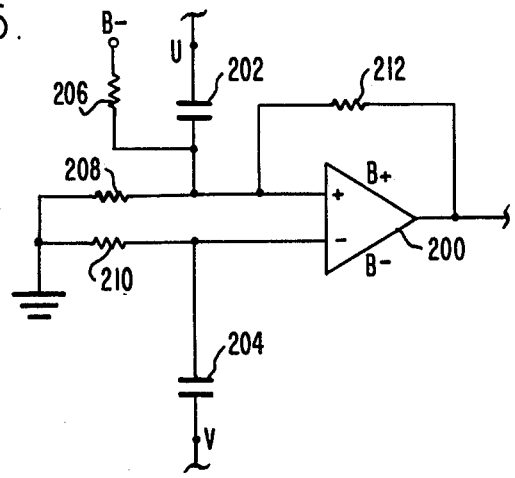
FIG. 5 is a circuit diagram of element 145 of FIG. 3.

FIG. 5 is a circuit diagram of the comparator and threshold circuit 145 of FIG. 3. The circuit 145 is based on a conventional differential amplifier 200. Node u is AC coupled to the positive input of amplifier 200 through a capacitor 202, and node v is AC coupled to the negative input of amplifier 200 through a further capacitor 204. A positive input of amplifier 200 is connected to B− through a resistor 206 and to ground through a resistor 208. A resistor 210 connects the negative input of amplifier 200 to ground. A further resistor 212 connects the output of amplifier 200 to the positive input thereof.

In operation, the output of amplifier 200 is normally low. Resistor 210 establishes a reference voltage, $V_{O-}$, of substantially ground level at the negative input of amplifier 200. In order for the amplifier 200 output to go from low to high, the voltage at the positive input of amplifier 200 must exceed the voltage at the negative input thereof by a slight off-set amount. Resistors 206 and 208 form a voltage divider which establishes a reference voltage, $V_{REF}$, of some negative voltage value, at the positive input of amplifier 200. $V_{REF}$ is adjusted to prevent the output of amplifier 200 from switching from its normal low state to a high state in response to signal levels at nodes u and v corresponding to the standard pan fire size or less. For signal levels at nodes u and v above the standard pan fire size, the output of amplifier 200 switches from low to high when the signal at node u is slightly greater than the signal at node v. Resistor 212 provides positive feedback to reduced jitter in the transitions of the output signal of amplifier 200.

Figure 6:
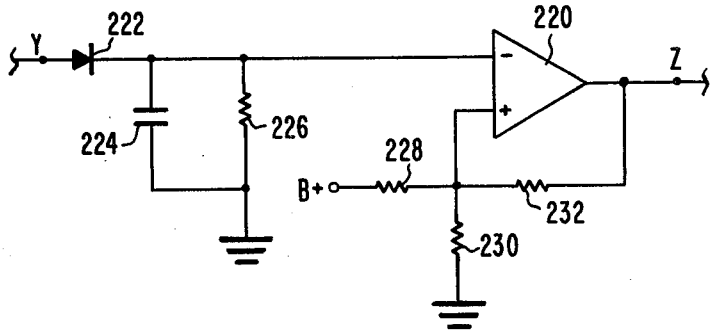
FIG. 6 is a circuit diagram of element 150 of FIG. 3.

FIG. 6 is a circuit diagram of fixed delay circuit 150 of FIG. 3. The circuit 150 is based on a conventional differential amplifier 220. Node y is connected to the negative input of amplifier 220 through a diode 222, as shown. A capacitor 224 and resistor 226 are connected in parallel between the negative input of amplifier 220 and ground. The positive input of amplifier 220 is connected to B+ through resistor 228 and to ground through resistor 230. Resistors 228 and 230 form a voltage divider which establishes a reference voltage, $V_{TIME}$, for the positive input of amplifier 220. A further resistor 232 connected between the output and the positive input of amplifier 220 reduces jitter in the transitions of the output of amplifier 220.

The output of amplifier 220, node z, is normally logical 1. When a logical 1 signal is applied to node y, current passes through diode 222, thus charging up capacitor 224. As capacitor 224 charges up, the voltage at the negative input of amplifier 220 exceeds reference voltage $V_{TIME}$, very quickly, thus causing the output of amplifier 220 to go from logical 1 to logical 0.

When node y goes from logical 1 to logical 0, diode 222 prevents capacitor 224 from discharging through diode 222. The time constant of the discharge of capacitor 224, is, therefore, substantially determined by the RC time constant of capacitor 224 and resistor 226. This RC time constant determines the delay which is characteristic of the fixed delay circuit 150. After a predetermined amount of time, determined by the aforementioned time constant, the voltage at the negative input of amplifier 220 goes below $V_{TIME}$, and the output of amplifier 220 goes from logical 0 to logical 1. In this way, fixed delay 150 provides a delay period which is referenced to the trailing edge of the logical signal which appears at node y.

Figure 4:
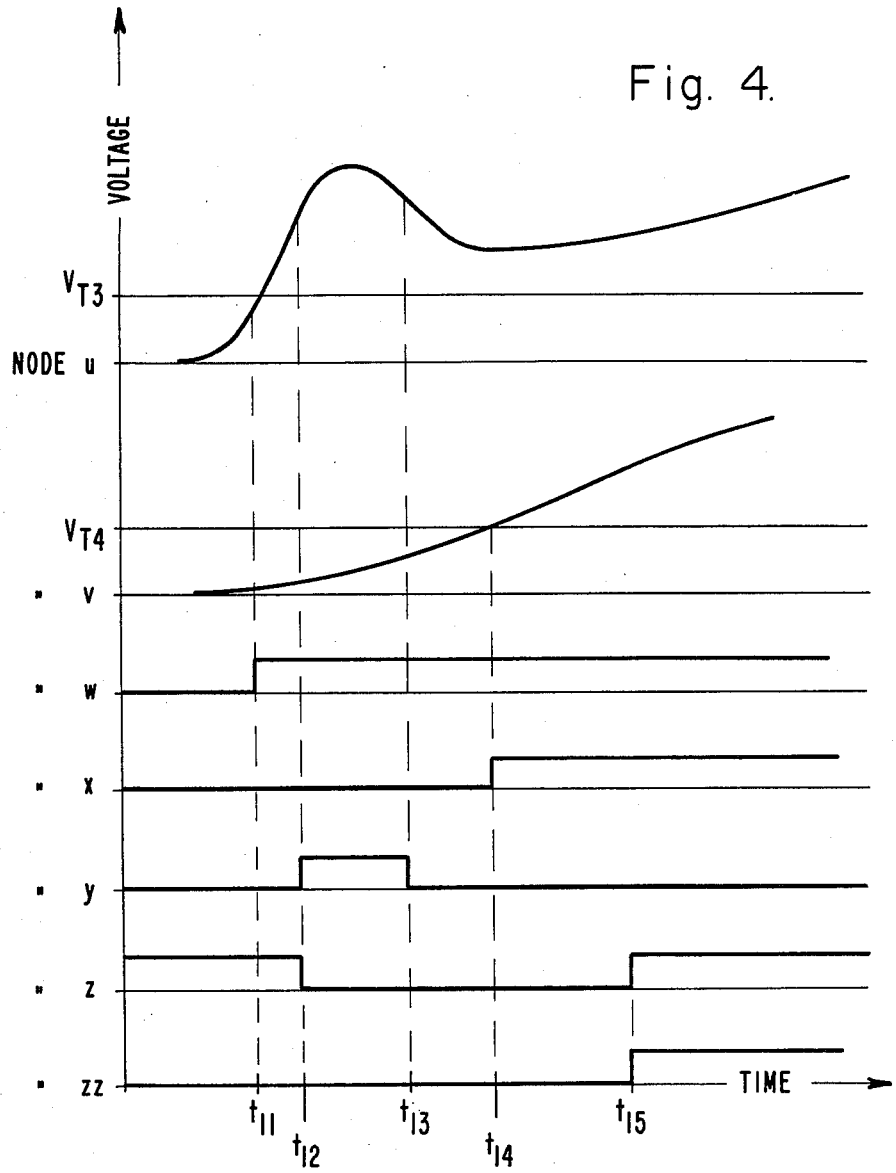
FIG. 4 is a timing diagram showing the operation of the sensor system of FIG. 3.

The operation of the sensor system 100 is shown by the timing diagram of FIG. 4 and is based on the same events depicted in FIG. 2. When the short wavelength component of the flash rises above its threshold level $V_{T3}$ at time $t_{11}$, the output of the threshold circuit 135 rises to a logical 1 as shown at node w in FIG. 4. From time $t_{12}$ to time $t_{13}$, the difference between the amplitudes of waveforms u and v exceeds the threshold value of the comparator-threshold circuit 145, and a logical 1 is generated and fed to the fixed delay circuit 150 (node y in FIG. 4). The fixed delay circuit 150 ceases generating its logical control signal at time $t_{12}$ as shown at node z in FIG. 4. The output of fixed delay circuit 150 remains at logical 0 until the comparator-threshold circuit 145 ceases generating its control signal at time $t_{13}$ and for a fixed predetermined period of time thereafter ($t_{13}$ to $t_{15}$).

At time $t_{14}$ the long wavelength component of the developing fire causes the waveform at node v to exceed the threshold value $V_{T4}$ and the threshold circuit 140 generates a logical 1 at its output, triggering the start of the fixed predetermined period of time of circuit 150. When the fixed predetermined period of time ends at $t_{15}$, the fixed delay circuit 150 again generates a logical 1. Since all inputs to the AND gate 155 are logical 1's, the AND gate 155 generates an output control signal that may be used to release a suppressant material to extinguish the developing fire.

It is understood that the above-described embodiment is merely illustrative of the many possible specific embodiments which can represent applications of the principles of this invention. For example, both channels of a two channel fire sensing device need not have associated risetime sensing circuits for control of a variable delay. Instead, only one channel might have a risetime sensing circuit for control of the variable delay. This and numerous other arrangements can be devised in accordance with these principles by those skilled in this art without departing from the spirit and scope of the invention.

What is claimed is:

1. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to said first and second radiant energy detectors, for generating a third control signal whenever the difference between the level of energy detected by said first detector and the level of energy detected by said second detector exceeds a third predetermined level;

(d) fourth control signal means, responsive to the third control signal, for:

(i) generating a fourth control signal whenever the third control signal is not generated, and (ii) ceasing generation of the fourth control signal whenever the third control signal is generated and for an additional predetermined amount of time after the third control signal ceases; and (e) output gate means, responsive to the first, second, and fourth control signals, for generating an output signal only when the first, second, and fourth control signals are all simultaneously generated.

2. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to said first and second radiant energy detectors, for generating a third control signal whenever the difference between the level of the energy detected by the first detector and the level of the energy detected by said second detector exceeds a third predetermined level;

(d) fourth control signal means, responsive to the output of the first and second detectors, for generating a fourth control signal having a duration which varies with the combined risetimes of the outputs of the first and second detectors;

(e) fifth control signal means, responsive to the third and fourth control signals, for generating a fifth control signal only when the third and fourth control signals are simultaneously not being generated; and (f) output control signal means, responsive to the first, second, and fifth control signals, for generating an output control signal only when the first, second, and fifth control signals are all simultaneously generated.

3. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to said first and second radiant energy detectors, for generating a third control signal whenever the difference between the level of the energy detected by said first detector and the level of the energy detected by the second detector exceeds a third predetermined level;

(d) fourth control signal means, responsive to the first radiant energy detector, for generating a fourth control signal having an amplitude that is proportional to the risetime of the output of the first detector;

(e) fifth control signal means, responsive to the second radiant energy detector, for generating a fifth control signal having an amplitude that is proportional to the risetime of the output of the second detector;

(f) sixth control signal means, responsive to the third, fourth and fifth control signals, for generating a sixth control signal in response to the third control signal, wherein the duration of the sixth control signal is proportional to the amplitudes of the fourth and fifth control signals;

(g) seventh control signal means, responsive to the third and sixth control signals, for generating a seventh control signal only when the third and sixth control signals are simultaneously not being generated; and (j) output control signal means, responsive to the first, second, and seventh control signals, for generating an output control signal only when the first, second, and seventh control signals are all simultaneously generated.

4. The sensory system of claim 1, 2, or 3 wherein the third control signal is generated when the amplitude of the output of the first detector exceeds the amplitude of the output of the second detector.

5. The sensor system of claim 1, 2, or 3 wherein the first spectral band is a broad spectral band within the region of 0.1 to 2.0 microns in wavelength and the second spectral band is a broad spectral band within the region of 5 to 30 microns in wavelength.

6. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within the second spectral band having a level greater than a second predetermined level;

(c) third control signal means, responsive to the first and second radiant energy detectors, for generating a third control signal whenever the difference between the amplitude of the energy detected by the first detector and the amplitude of the energy detected by the second detector exceeds a third predetermined level;

(d) fourth control signal means, responsive to the third control signal, for:

(i) generating a fourth control signal when the third control signal is generated, and (ii) continuing to generate the fourth control signal for a predetermined period of time after the third control signal ceases to be generated;

(e) fifth control signal means, responsive to the third and fourth control signals, for generating a fifth control signal only when the third, and fourth control signals are both simultaneously not being generated; and (f) output control signal means, responsive to the first, second, and fifth control signals, for generating an output control signal only when the first, second, and fifth control signals are all simultaneously generated.

7. A sensor system responsive to a fire or explosion comprising:

(a) first control signal means, responsive to a first radiant energy detector, for generating a first control signal when the first detector detects electromagnetic energy within the first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to the first and second radiant energy detectors, for generating a third control signal whenever the difference between the amplitude of the energy detected by the first detector and the amplitude of the energy detected by the second detector exceeds a third predetermined level;

(d) fourth control signal means, responsive to the output of the first and second detectors, for generating a fourth control signal having a duration that increases as the combined rates of increase of the outputs of the first and second detectors;

(e) fifth control signal means, responsive to the third and fourth control signals, for generating a fifth control signal only when the third and fourth control signals are both simultaneously not being generated; and (f) output control signal means, responsive to the first, second, and fifth control signals, for generating an output control signal only when the first, second, and fifth control signals are all simultaneously generated.

8. A sensor system responsive to a fire or explosion comprising:

(a) first control signal means, responsive to a first radiant energy detector, for generating a first control signal when the first detector detects electromagnetic energy within a first spectral band having an amplitude greater than a first predetermined level;

(b) second control signal means, responsive to a second radiant energy detector, for generating a second control signal when the second detector detects electromagnetic energy within a second spectral band having an amplitude greater than a second predetermined level;

(c) third control signal means, responsive to the first and second radiant energy detectors, for generating a third control signal whenever the difference between the amplitude of the energy detected by the first detector and the amplitude of the energy detected by the second detector exceeds a third predetermined level;

(d) fourth control signal means, responsive to the first radiant energy detector, for generating a fourth control signal having an amplitude which varies as the risetime of the output of the first detector varies;

(e) fifth control signal means, responsive to the second detector, for generating a fifth control signal having an amplitude which varies as the risetime of the output of the second detector varies;

(f) sixth control signal means, responsive to the third, fourth, and fifth control signals, for generating a sixth control signal in response to the third control signal, wherein the duration of the sixth control signal is porportional to the amplitudes of the fourth and fifth control signals;

(g) seventh control signal means, responsive to the third and sixth control signals, for generating a seventh control signal only when the third and sixth control signals are both simultaneously not being generated.

9. The sensor system of claim 8 wherein the fifth control signal means comprises:

(a) a time constant circuit responsive to the output of the second detector when the third control signal is generated; and (b) a threshold circuit responsive to the time constant circuit for generating the fifth control signal when the time constant circuit is charged above a fourth predetermined level.

10. The sensor system of claim 8 wherein the fourth control signal means comprises:

(a) a time constant circuit responsive to the output of the first detector when the third control signal is generated; and (b) a threshold circuit responsive to the time constant circuit for generating a fourth control signal when the time constant circuit is charged above a fourth predetermined level; and further comprising sixth control signal means responsive to the second radiant energy detector for generating a sixth control signal having a duration that varies in accordance with the risetime of the output of the second detector.

11. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to the first and second radiant energy detectors, for generating a third control signal when the amplitude of the output of the first detector exceeds the amplitude of the output of the second detector;

(d) fourth control signal means, responsive to the third control signal, for:

(i) generating a fourth control signal when the third control signal is generated, and (ii) continuing to generate the fourth control signal for a predetermined period of time after the third control signal ceases to be generated.

12. The sensor system of claim 11 wherein the fourth control signal means comprises:

(a) a time constant circuit responsive to the output of the first detector when the third control signal is generated; and (b) a threshold circuit responsive to the time constant circuit for generating the fourth control signal when the time constant circuit is charged above a fourth predetermined level.

13. The sensor system of claims 12 or 9 wherein the time constant circuit is an R-C network.

14. The sensor system of claim 11 wherein the fourth control signal means comprises:

(a) a dual time-constant circuit responsive to the outputs of the first detector and the second detector when the third control signal is generated;

(b) a dual threshold circuit responsive to the dual time-constant circuit for generating digital outputs when the dual time-constant circuit is charged above a fourth and fifth predetermined level respectely; and (c) AND gate means responsive to the digital outputs of the dual threshold circuit for generating a fourth control signal when both digital outputs are simultaneously generated.

15. The sensor system of claim 14 wherein the dual time constant circuit comprises a dual R-C network.

16. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to the first and second radiant energy detectors, for generating a third control signal whenever the ratio of the amplitudes of the energy detected by the first detector and the amplitude of the energy detected by the second detector exceeds a third predetermined level;

(d) fourth control signal means, responsive to the first radiant energy detector, for generating a fourth control signal having an amplitude which varies in accordance with the risetime of the output of the first detector;

(e) fifth control signal means, responsive to the third and fourth control signals, for generating a fifth control signal when the third control signal is generated, and wherein the duration of the fifth control signal varies in accordance with the amplitude of the fourth control signal;

(f) sixth control signal means, responsive to the third and fifth control signals, for generating a sixth control signal only when the third and fifth control signals are both simultaneously not being generated; and (g) output control signal means, responsive to the first, second, and sixth control signals, for generating an output control signal only when the first, second, and sixth control signals are all simultaneously generated.

17. A sensor system responsive to a fire or explosion comprising:

(a) first control signal means, responsive to a first radiant energy detector, for generating a first control signal when the first detector detects electromagnetic energy within a first spectral band having a level greater than a first predetermined level;

(b) second control signal means, responsive to a second radiant energy detector, for generating a second control signal when the second detector detects electromagnetic energy within a second spectral band having a level greater than a second predetermined level;

(c) third control signal means, responsive to the first and second radiant energy detectors, for generating a third control signal whenever the difference between the amplitude of the energy detected by the first detector and the amplitude of the energy detected by the second detector exceeds a third predetermined level;

(d) fourth control signal means, responsive to the second radiant energy detector, for generating a fourth control signal having an amplitude which varies in accordance with the risetime of the output of the second detector;

(e) fifth control signal means, responsive to the third and fourth control signals, for generating a fifth control signal in response to the third control signal and wherein the duration of the fifth control signal varies in accordance with the amplitude of the fourth control signal;

(f) sixth control signal means, responsive to the third and fifth control signals, for generating a sixth control signal only when the third and fifth control signals are both simultaneously not being generated; and (g) output control signal means, responsive to the first, second, and sixth control signals, for generating an output control signal only when the first, second, and sixth control signals are all simultaneously generated.

18. A method of inhibiting the output of a fire sensing device for a period of time that varies as the risetime of optical radiation from a fire which is sensed by said device, comprising the steps of:

(a) inhibiting the generation of an output signal;

(b) generating a first control signal the duration of which increases as the risetime of the optical radiation; and (c) removing the inhibition of the generation of the output signal when the first control signal ceases to be generated.

19. The method of claim 18 further comprising the steps of:

(a) generating a second control signal whose amplitude is proportional to the intensity of the optical radiation as that intensity is increasing;

(b) allowing the second control signal to decay in a predetermined manner when the intensity of the optical phenomenon begins to decay;

(c) generating a third control signal when the second control signal has fallen below a predetermined level; and (d) removing the inhibition of the generation of the output signal when the third control signal is generated and the first control signal ceases to be generated.

20. A method of sensing a fire or explosion which is present at a predetermined threshold level and at a predetermined time after the onset of the fire or explosion-causing mechanism, the method comprising the steps of:

(a) detecting the increasing electromagnetic radiation produced by the onset of the fire or explosion-causing mechanism and generating an inhibit signal in response thereto;

(b) comparing different spectral bands of the detected electromagnetic radiation generated by the fire or explosion, and generating an inhibit-remove output signal when predetermined decay characteristics of the magnitudes of radiation from the spectral bands are reached; and thereafter (c) detecting the radiation received from the different spectral bands after the removal of the inhibit signal, and generating a fire suppression output signal when the radiation in each spectral band exceeds a predetermined threshold, whereby discrimination in both magnitude and duration of radiation in each spectral band is provided.

21. A method for simulating a rapidly occurring transient optical phenomenon with electrical means, comprising the steps of:

(a) generating a control signal whose amplitude is proportional to the intensity of the optical phenomenon as that intensity is increasing;

(b) allowing the control signal to decay in a predetermined manner when the intensity of the optical phenomenon begins to decay; and (c) generating an output signal when the control signal has fallen below a predetermined level.

22. A method of simulating a rapidly occurring transient optical phenomenon with electrical means, comprising the steps of:

(a) inhibiting the generation of an output signal;

(b) generating a first control signal whose amplitude is proportional to the intensity of the optical phenomenon as that intensity is increasing;

(c) allowing the first control signal to decay in a predetermined manner when the intensity of the optical phenomenon begins to decay;

(d) generating a second control signal when the first control signal has fallen below a predetermined level; and (e) removing the inhibition on the generation of the output signal when the second control signal is generated.

* * * * *